United States Patent [19]

Desiderio

[11] Patent Number: 4,936,572

[45] Date of Patent: Jun. 26, 1990

[54] SEAT SUPPORT BRACKET FOR AN EXERCISING DEVICE

[76] Inventor: Ronald Desiderio, 400 Wharton Cir., SW., Atlanta, Ga. 30336

[21] Appl. No.: 415,704

[22] Filed: Oct. 2, 1989

[51] Int. Cl.[5] ..... A63B 21/072

[52] U.S. Cl. ..... 272/123; 272/144; 248/291

[58] Field of Search ..... 272/93, 117, 123, 144; 108/1; 248/291, 293; 297/328, 377

[56] References Cited

U.S. PATENT DOCUMENTS

| | | | |
|---|---|---|---|
| 1,675,718 | 7/1928 | Lynch | 248/293 X |
| 2,874,613 | 2/1959 | Bogar, Jr. | 248/291 X |
| 4,566,691 | 1/1986 | Mahnke | 272/123 |
| 4,653,751 | 3/1987 | Green | 272/144 |

FOREIGN PATENT DOCUMENTS

| | | | |
|---|---|---|---|
| 3423837 | 1/1986 | Fed. Rep. of Germany | 272/144 |

*Primary Examiner*—Robert W. Bahr
*Attorney, Agent, or Firm*—Myron Amer

[57] ABSTRACT

A pivotally mounted inverted U-shaped bracket serving as a prop beneath the front of a bench press seat movable through a pivotal traverse from an out-of-the-way storage position in convering relation over an inverted U-shaped support of the bench press into an angled seat-propping position, in which a traverse edge of a top panel opening of the bracket serves as a stop for the pivotal traverse.

1 Claim, 3 Drawing Sheets

SEAT SUPPORT BRACKET FOR AN EXERCISING DEVICE

The present invention relates generally to improvements for a bench press, and more particularly to improvements in the manner in which the seat for the bench press is placed in its different positons of use.

In using a bench press, and when the user is in a prone exercising position, the seat of the bench must of course be horizontal, and when exercising from a sitting position, it is necessary that the seat then be adjusted appropriately into an inclined position. Seat-supporting and position-adjusting structures are, of course, already well known, but are not entirely satisfactory. One shortcoming is that these structures when not in use, such as when they are not actually propping the seat up in an inclined position, are either hanging down or off to one side of the bench, but in either case are not in entirely out of the way positions. Another shortcoming is that the propped up seat position is usually achieved using a pin, and this component by reason of bearing the full weight exerted upon the seat is vulnerable to inadvertent shearing.

Broadly, it is an object of the present invention to overcome the foregoing and other shortcomings of the prior art. More specifically, it is an object providing seat-propping structure for a bench press that in a storage or non-use condition is out of the way, and also is readily easy to use in providing the seat with its different positions of use, as well as having other noteworthy advantages and benefits as will be more fully subsequently described herein.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
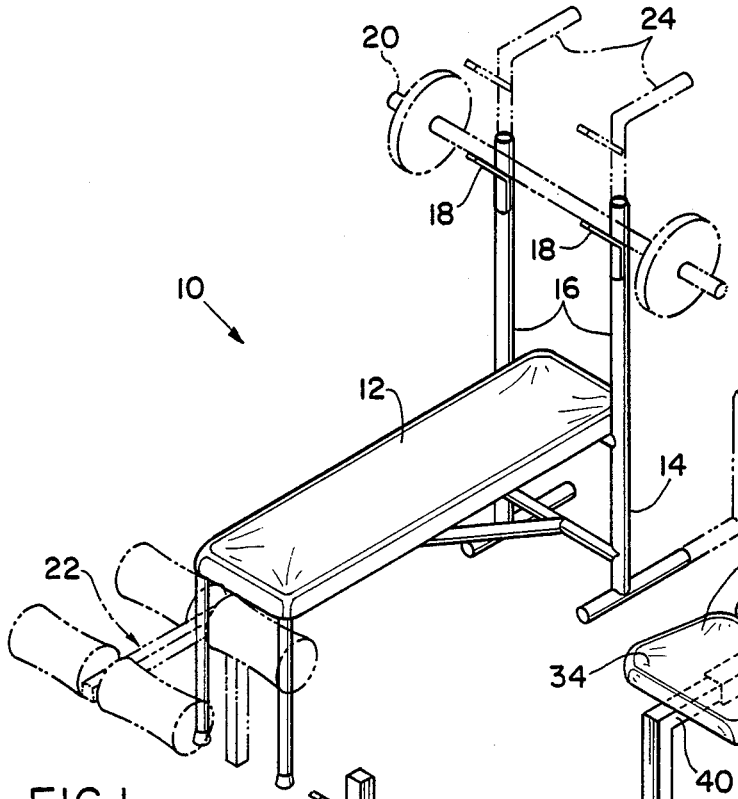
FIG.1 PRIOR ART
FIG. 1 is a perspective view of a simplified exercise bench exemplifying the prior art.

One basic exercise unit of long standing is a bench 10 of the type used for a barbell bench press. A typically known prior art unit is shown in FIG. 1 in its simplest form. Generally, bench 10 consists of a Naugahyde covered, padded board 12 assembled on a steel welded frame 14 with four legs. At the "head" end of bench 10, the two legs are extended to form standards 16 which are fitted with at least one pair of hooklike members 18 to support a weighted barbell 20. The exerciser uses bench 10 by lying flat with head, shoulders and buttocks in contact with board 12, while the knees are bent and feet are flat on the floor. He/she then grips the barbell 20 and removes it from the hooks 18. The weight is lowered to the chest and then pressed upward for full arm extension. The basic routine is repeated according to a prescribed schedule. At the end of the prescribed lifting and lowering cycle the barbell is replaced on hooks 18 with the aid of an assistant or so-called spotter if needed.

Some units 10 can be made with "add-ons" such as leg extension apparatus 22 or with parallel bars 24 that can be extended from the standards 26. Bench 10, itself, may be part of one of the many available multipurpose exercise machines 26.

Figure 2:
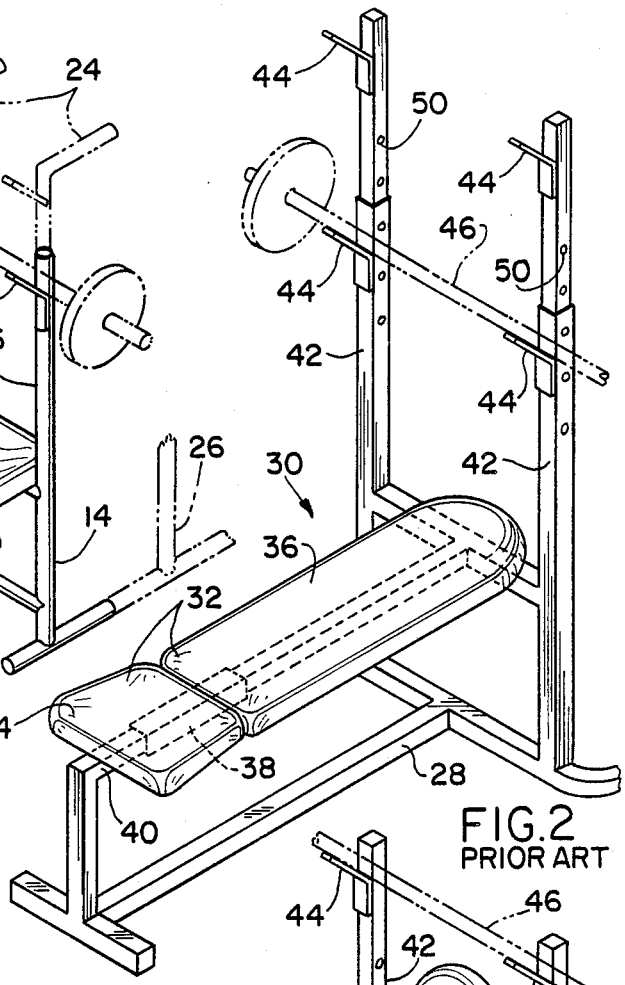
FIG.2 PRIOR ART
FIG. 2 is similarly a perspective view of another, somewhat advanced model, of a prior art exercise bench.

For comparison with the within inventive bench press seat, subsequently to be described and illustrated in detail, a more advanced version of the basic prior art bench press, designated 30, is illustrated in prior art labelled FIGS. 3, 4, and 5. The frame 28 of bench 30 is preferably made of sturdy, square, all welded tubing while the padded board member 32 is divided into two sections 34 and 36. Generally, board sections 34 and 36 are hingedly joined to a channel or tubing member 38 which is adjustably fastened along the main support member 40 of frame 28. Standards 42 are made in a telescoping fashion so that the upper hooks 44 may be raised or lowered to suit the user in supporting barbell 46. The upper sections of standards 42 are held in place by suitable pins or screw devices (not shown). When board sections 34 and 36 are in their horizontal position of use (FIG. 2), the user can proceed with bench presses as described in connection with bench 10.

When the exerciser wants to change to an inclined exercising position to do a set of bench presses, the channel member 38 is relocated along frame member 40 towards the standards 42 end. Section 36 of the board is lifted and supported by a bar which may rest on lower hooks 44 or which may pass through holes 50 in standards 42. The level of bar 48 and the location of channel member 38 determines the angle of section 36 relative to member 40, and usually is about 20 degrees to 40 degrees.

Figure 3:
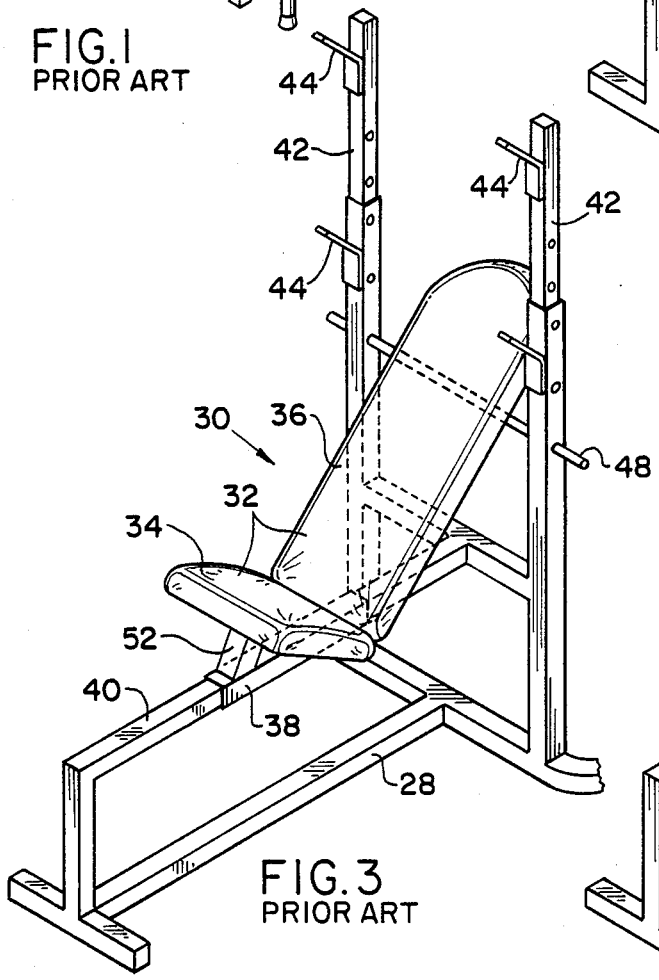
FIG.3 PRIOR ART
FIG. 3 is a perspective view of the bench of FIG. 2 adjusted from its horizontal to its inclined position of use.
Figure 4:
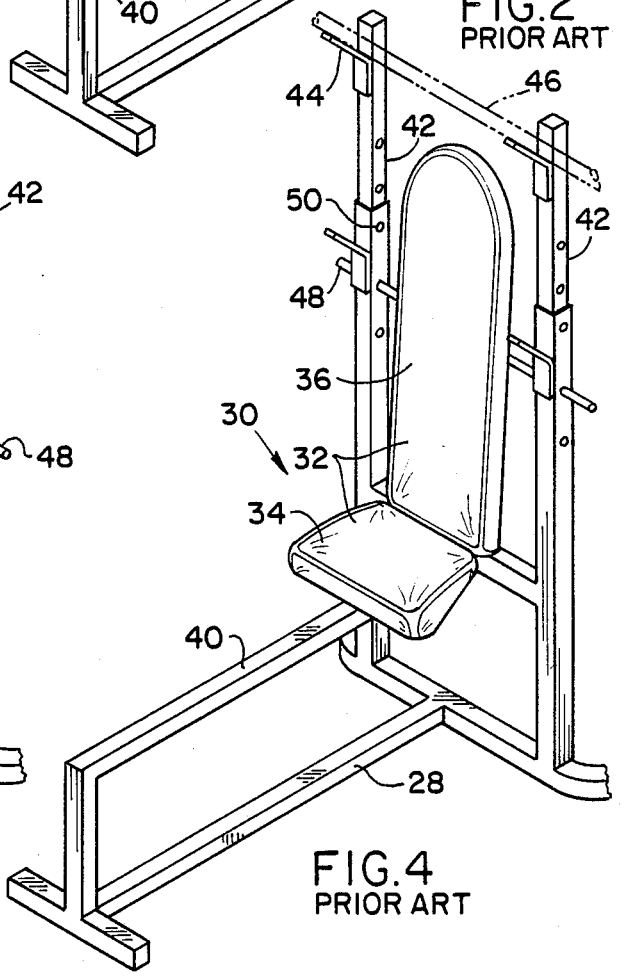
FIG.4 PRIOR ART
FIG. 4 is a perspective view of the prior art bench adjusted to a vertical position of use.

Section 34 of board 32 in the use positon of FIG. 3 now becomes a seat relative to section 36, and this requires that it be "propped" up by support means 52. As will be described subsequently herein, particularly in connection with FIGS. 11-15, the patentable advance herein is in connection with the structure used in "propping" up the bench press seat. Continuing however with the description of background, it is to be noted that when section 34 becomes a seat, section 36 becomes a backrest for the exerciser to perform incline bench presses. This exercise is carried out much like the flat bench press procedure previously described.

For completeness sake it is also noted that seated-behind-the-neck presses is a further exercise that the user of bench 30 may include in his/her routine. As the name of the exercise implies, backrest section 36 and seat section 34 of the board 32 are adjusted to form a seat for the user. Channel member 38 is moved further along support 40 towards standards 42 until backrest 36 is almost vertical. Seat 34 is returned to its horizontal position by adjustment of support means 52. For barbell 46 to be in position for this exercise, extensions on standards 42 may have to be elevated (See FIG. 4).

To perform the seated-behind-the-neck press, the user sits upright on seat 34 facing away from standards 42 and grips barbell 46 with fingers facing foreward. He/she then lowers the bar 46 to rest on the shoulders behind the neck. The weight 46 is pressed directly upward until the arms are fully extended, and then lowered slowly to the starting position on the shoulders.

Since the subject of the present invention is specifically concerned with improvements in the support means 52 for seat 34, for comparison two prior art embodiments will now be reviewed.

Figure 5:
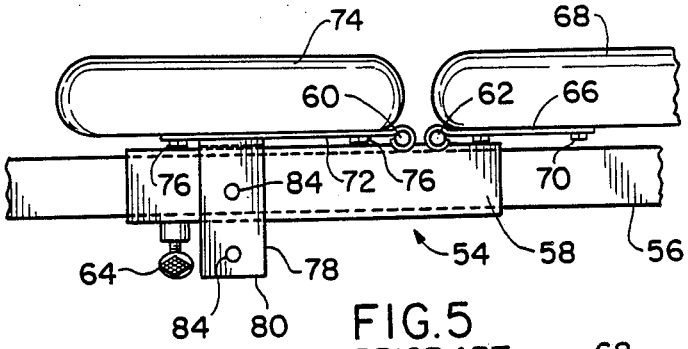
FIG.5 PRIOR ART
FIG. 5 is a detailed side elevational view of the construction of the seat support typically used for the prior art bench of FIG. 1.
Figure 6:
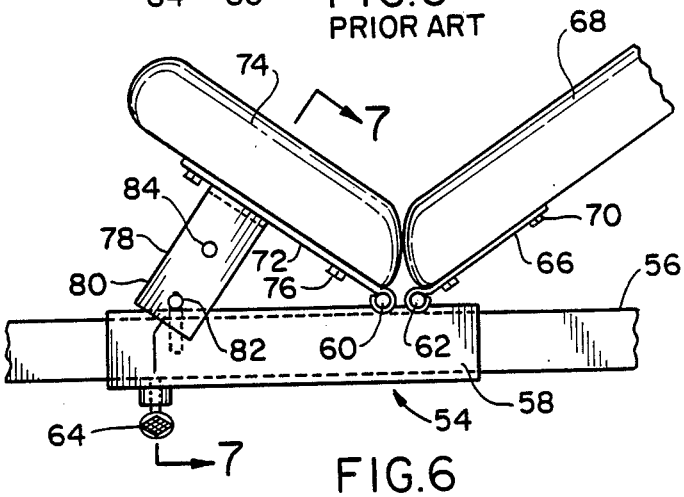
FIG.6 PRIOR ART
FIG. 6 is a view similar to FIG. 5, but illustrating the inclined seat position thereof.
Figure 7:
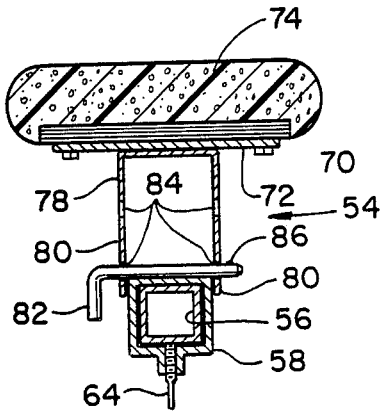
FIG.7 PRIOR ART
FIG. 7 is a sectional view as taken along line 7—7 of FIG. 6.

In FIGS. 5, 6 and 7 a first prior art bench press seat support of device 54 is shown in its horizontal (FIG. 5) and elevated positions (FIGS. 6, 7) relative to support member 56. Member 56 is disposed within and thus encircled about its four sides by a length of square tubing 58 which forms a base for two separatae hinge pins 60 and 62 which, in practice, are welded thereon. The lower face of tubing 58 is fitted with a thumb type lock screw 64 used to fix tubing 58 in position along member 56. Hinge pin 62 supports a hinge leaf 66 attached to backrest 68 by lag screws 70. In like manner pin 60 supports a hinge leaf 72 attached to seat member 74 by lag screws 76. Approximately on the center of seat 74, a "U" shaped bracket 78 is welded to leaf 72. Dependent legs 80 of bracket 78 straddle tubing 58 and are necessarily of a size that as best shown in FIG. 5 extends below the bottom edge of support 56. Each of the legs 80 has a pair of vertically alligned pin holes 84 to selectively receive a transverse pin 82. Selection of upper or lower hole 84 provides a choice of seat positions for the user. Pin 82 may be provided with detent means 86 for safety's sake, and when in position it is primarily only pin 82 which supports the forces acting on seat member 74.

Backrest 68 can also be supported by means similar to rod 48 of bench 30, as previously described in connection with FIG. 3.

Figure 8:
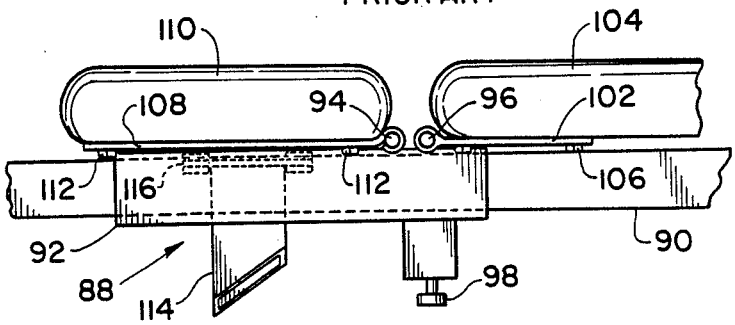
FIG.8 PRIOR ART
FIG. 8 is a detailed side elevational view, similar to FIG. 5, but of another typical prior art seat support construction.
Figure 9:
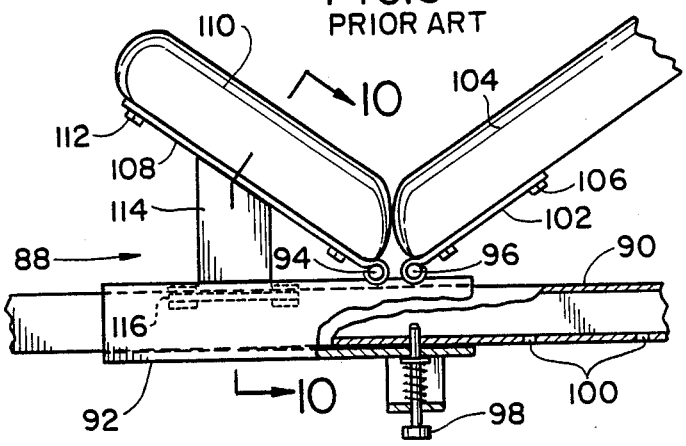
FIG.9 PRIOR ART
FIG. 9 is a view similar to FIG. 8, but illustrating the inclined seat position thereof.
Figure 10:
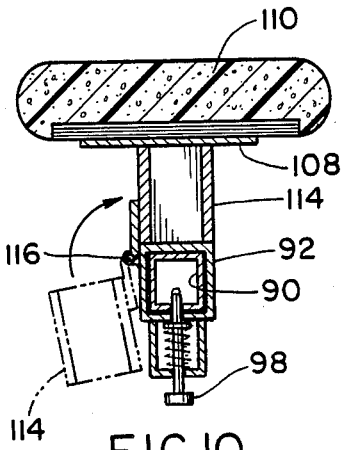
FIG.10 PRIOR ART
FIG. 10 is a sectional view as taken along line 10—10 of FIG. 9.

Shown in FIGS. 8, 9 and 10, is a second prior art device 88 in its horizontal (FIG. 8) and inclined positions (FIGS. 9 and 10) relative to the support member 90. Member 90 is disposed within and thus encircled about its four sides by a length of square metal tubing 92 which forms a base for two separate hinge pins 94 and 96 which, in practice, are welded thereon. The lower face of tubing 92 is fitted with a spring biased pin 98 which engages a selected one of spaced holes 100 on the lower face of member 90 to hold tubing 92 in a specific location. Hinge pin 96 supports a hinge leaf 102 atached to backrest 104 by lag screws 106. In like manner pin 94 supports a hinge leaf 108 attached to seat member 110 by lag screw 112. On one side of tubing 92 a prop member 114, made of rectangular metal tubing, is hingedly connected at hinge point 116. When prop 114 is not in use, it remains suspended on one side of support 90, as shown in FIG. 10, during which seat 110 is in its horizontal position of use. To use prop 114, seat 110 is raised and prop 114 is simply rotated about hinge 116 to rest on the upper surface of tubing 92. The hinge leaf 108 of seat 110 is then lowered to bear on the upper angled face of prop 114, as best seen in FIG. 9. Backrest 104 is supported by means similar to rod 48 of bench 30, as previously described in connection with FIG. 3.

In contrast to prior art seat-propping structure which either depends below its support as depicted in FIG. 5, or is suspended on one side thereof as depicted in FIG. 10, the structure which provides this function according to the present invention is entirely out of the way in its storage or non-use position, all as will now be described and illustrated in connection with FIGS. 11–14. More particularly, in FIGS. 11 through 14 the within inventive seat support, designated 118, is shown in its horizontal (FIGS. 11, 13) and inclined positions (FIGS. 12, 14) relative to a support member 120. A channel or inverted U-shaped member 122 is disposed in covering relation over support 120 and has welded thereon a pair of hinge pins 124 and 126. The dependent sides 130 of channel 122 lie against the sides of support 120 and in practice a friction-reducing tape or coating 128 is applied to these sides and to the top interior surface of channel 122 to facilitate movement of member 122 along support 120 incident to adjusting the position of device 118. On one of the channel sides 130 a spring biased pin 132 is held captive within housing 134. When the position of channel 122 is to be relocated, pin 132 is withdrawn and realigned to a different hole 136 in the corresponding side of support 120. Pin 132 assures a secure, safe means of locking device 118 in place during use.

Hinge pin 126 supports a hinge leaf 138 attached to backrest 140 by lag screws 142. In like manner pin 124 supports a hinge leaf 144 attached to seat member 146 by lag screws 148.

Figure 12:
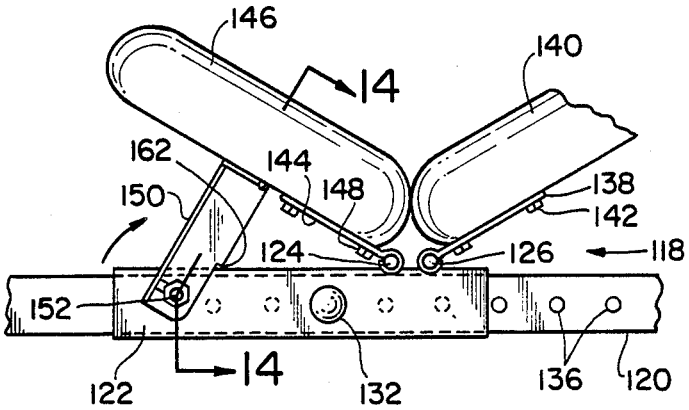
FIG. 12 is a view similar to FIG. 11, but illustrating the inclined mode or position of use.
Figure 14:
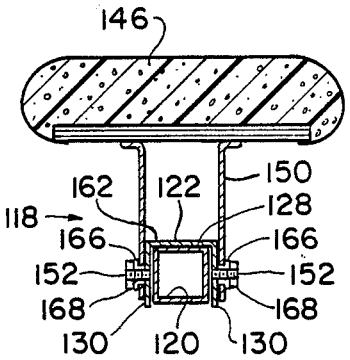
FIG. 14 is a sectional view as taken along line 14—14 of FIG. 12.
Figure 15:
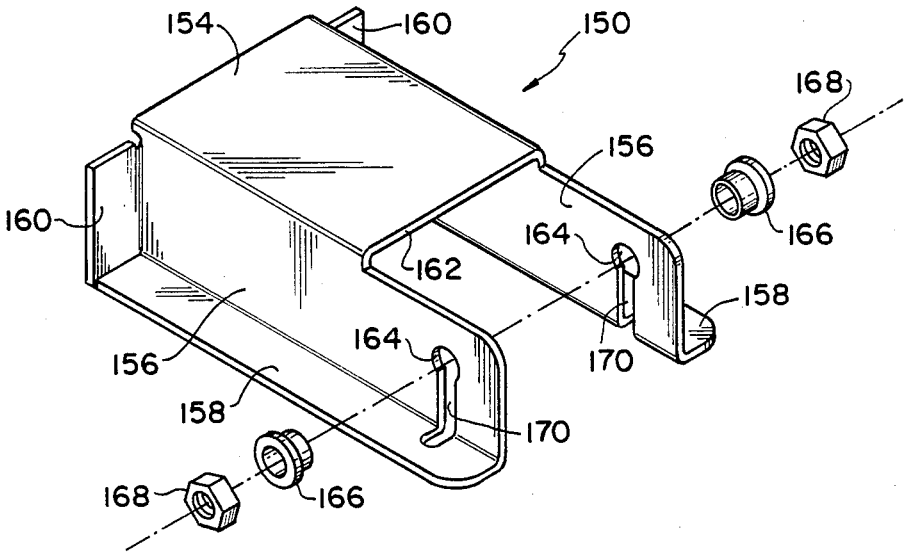
FIG. 15 is an enlarged scale isolated perspective view of the bracket component of the within inventive exercise bench seat.

A bracket 150 serves as a prop member to hold seat 146 in the elevated position as shown in FIG. 12. Bracket 150 is mounted for pivotal movement about a pair of studs 152 fastened to sidewalls 130 of channel 122 (FIG. 14). Bracket 150 is made of heavy guage steel in an open rectangular or U-shape in which, as best seen in FIG. 15, a front panel 154 joins two sidewalls 156, said front panel 154 being approximately only two thirds the length of the sidewalls 156 so that there is a rectangular opening or removed section at one end of the front panel 154 which is bounded by the edge 162 which performs a function soon to be described. Flanges 158 run the length of unit 150 at the bottom of sidewalls 156 while additional flanges 160 are used as a bearing surface for seat 146 when in the raised position. Also when in the raised position the edge 162 of panel 154 acts as a stop establishing the angle of bracket 150 relative to channel 122. To locate bracket 150 on channel 122, the laterally extending studs 152 of channel 122 are received in slots 170 and bracket 150 then moved down over channel 122 until the studs 152 project through openings 164. Flanged nylon bushings 166 are then inserted about the studs 152 and held in place by nuts 168.

Figure 11:
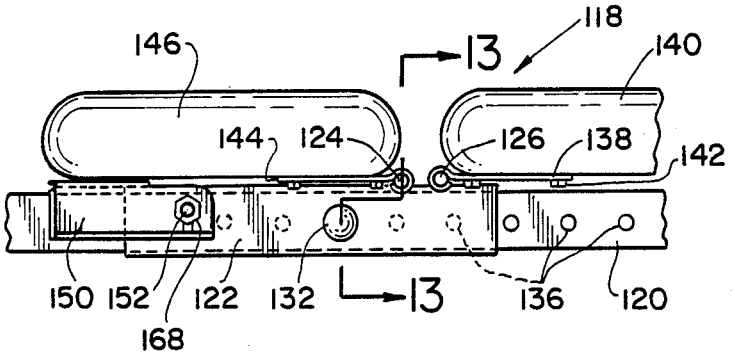
FIG. 11 is a detailed side elevational view of the within inventive seat support construction as shown in its horizontal mode or position of use.

As depicted in FIG. 11, bracket 150, as well as seat member 146, are in their horizontal position. To provide its inclined position of use, seat 146 is first raised and then bracket 150 is rotated (clockwise as seen in FIG. 12) as far as it will go, which when edge 162 contacts the upper surface of chanel 122 automatically positions it to fully support seat 146 and the load thereon. Backrest 140 is supported by means similar to rod 48 of bench 30.

By merely releasing pin 132, channel 122, which has attached to it both the seat 146 and backrest 140, is correspondingly released and thus assembly 118 can be easily removed from support 120 should it be desired to apply to support 120 other type exercise equipment.

Figure 13:
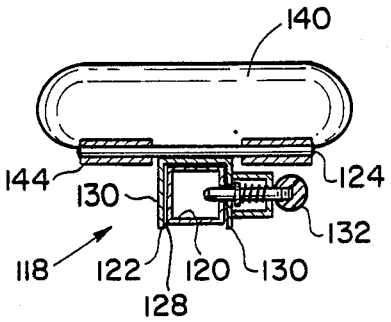
FIG. 13 is a sectional view as taken along line 13—13 of FIG. 11.

In summary, the improved seat-propping structure hereof, generally designated 118, is noteworthy in having its component 150 when not in use in an entirely out of the way storage position, as best shown in FIGS. 11, 13, and when in use in providing seat 146 with its inclined position, as best shown in FIGS. 12, 14, wherein this position is established at a preselected angle automatically by contact of the bracket stop 162 against the channel 122, as well as providing the other benefits and advantages previously described.

While the particular bench press seat support herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. For use with an exercise bench press of the type having a seat operatively arranged for linear movement along a horizontally oriented support and also pivotally movable relative to said support into an angular orientation, an improved seat-propping member comprising an inverted U-shaped member being disposable in covering relation over the support and movable therealong conjointly with the bench press seat, an inverted U-shaped bracket consisting of a top panel joining opposite depending sidewalls disposed in covering relation over said inverted U-shaped member, means for pivotally attaching one end of said bracket to said member, said bracket sidewall ends remote from said pivot having laterally extending flanges serving as contact surfaces for additional engagement with the bench press seat, a rectangular section being removed from said bracket top panel at said pivotally mounted end thereof effective to provide an edge bounding said removed section for limiting pivotal movement of said bracket until contact of said edge with said member, whereby incident to said pivotal movement said bracket is located in an angular position serving as a prop for said seat in a corresponding angular position.

* * * * *